US011724167B2

(12) United States Patent
Stieneker

(10) Patent No.: US 11,724,167 B2
(45) Date of Patent: Aug. 15, 2023

(54) LASSO YARD GAME

(71) Applicant: Brian Stieneker, South Lyon, MI (US)

(72) Inventor: Brian Stieneker, South Lyon, MI (US)

( * ) Notice: Subject to any disclaimer, the term of this patent is extended or adjusted under 35 U.S.C. 154(b) by 38 days.

(21) Appl. No.: 17/556,532

(22) Filed: Dec. 20, 2021

(65) Prior Publication Data

US 2023/0191217 A1 Jun. 22, 2023

(51) Int. Cl.
*A63B 67/06* (2006.01)
*A63B 71/06* (2006.01)

(52) U.S. Cl.
CPC ..... *A63B 67/06* (2013.01); *A63B 71/06* (2013.01); *A63B 2067/063* (2013.01); *A63B 2071/0694* (2013.01)

(58) Field of Classification Search
CPC ... A63B 67/06; A63B 2067/063; A63B 67/10; A63B 69/0068; A63B 71/06; A63B 2071/0602; A63D 7/00; A01K 15/003; A01K 15/02; F41J 5/18; F41J 7/04; A63F 9/30–305; A63F 2009/0213; A63F 9/0243
See application file for complete search history.

(56) References Cited

U.S. PATENT DOCUMENTS 1,290,034 A * 1/1919 Amlung ..... A63F 9/0204 273/389
3,066,939 A * 12/1962 Sprout ..... A63F 9/02 273/338
3,520,535 A 7/1970 Dubbs et al.
3,815,915 A 6/1974 Chapman
3,974,799 A * 8/1976 Parsons ..... A63B 69/0068 273/359
4,120,498 A 10/1978 Mutschler et al.
D285,811 S 9/1986 Donahoe
5,620,185 A 4/1997 Robertson
7,543,820 B2 * 6/2009 King ..... F41J 7/04 273/390
8,011,664 B2 9/2011 Hilbert, Jr. et al.
D783,094 S 4/2017 Shepherd
2013/0062830 A1 3/2013 Brunner
2014/0049007 A1 2/2014 McGetrick et al.
2015/0115530 A1 4/2015 Vanston
2018/0318684 A1 11/2018 Robinson et al.

OTHER PUBLICATIONS

Fun Express, "Puppy Dog Ring Toss Game," https://www.amazon.com/Cute-Puppy-Ring-Toss-Game/dp/B08CS1HQKX, release date Jan. 1, 2021 (Year: 2021).*
Oriental Trading Company, "Cross Ring Toss Game," http://www.orientaltrading.com:80/cross-ring-toss-game-a2-13785960.fltr, archived by the Internet Archive on May 2, 2018 (Year: 2018).*
(Continued)

*Primary Examiner* — Laura Davison
(74) *Attorney, Agent, or Firm* — Brooks Kushman P.C.

(57) ABSTRACT

A unique game piece for competing in a novel game is disclosed. The game piece is configured to move from a first position to a second position. The game piece includes a base and a fixture and an indicator configured to extend therefrom in different directions such that when the game piece is moved from the first position to the second position the indicator become apparent or discernible.

8 Claims, 7 Drawing Sheets

(56) References Cited

OTHER PUBLICATIONS

Pam's Party and Practical Tips, "Horse/Western Party," https://www.pamspartyandpracticaltips.com/2011/04/horsewestern-party.html, posted Apr. 21, 2011 (Year: 2011).*

Kaplan, "Meadow Ring Toss Game," https://www.kaplanco.com/product/62844/meadow-ring-toss-game, archived by the Internet Archive on Feb. 24, 2021 (Year: 2021).*

Raising Dragons, "Hula Hoop Lasso Challenge," https://www.raisingdragons.com/hula-hoop-lasso-challenge/, archived by the Internet Archive on May 22, 2020 (Year: 2020).*

Leisure Hire, "Cactus Lasso," https://www.leisurehire.com/product/cactus-lasso/, archived by the Internet Archive on Aug. 3, 2020 (Year: 2020).*

* cited by examiner

LASSO YARD GAME

TECHNICAL FIELD

The present disclosure relates to a device for a game and in one or more embodiments a device for a yard game.

BACKGROUND

Games, sport, and play have been forms of entertainment and socialization for human beings for centuries. Games invoke joy and entertainment by allowing competition in a friendly and structured manner. Lawn or yard games further allow competitors and spectators to enjoy the outdoors while participating in a competitive and social context. The introduction of new games may be exciting, add new challenges, and/or elicit new skills.

SUMMARY

In one embodiment, a game piece is disclosed. The game piece includes a base, and a fixture and indicator configured to extend therefrom. The base may have a first surface configured to contact a support surface while in a first position and a second surface configured to be in contact with the support surface while in a second position. The fixture may be elongated and extend from the base to a first height above the support surface when in the first position and to a second height above the support surface when in the second position. The indicator, likewise, extends to a third height above the support surface when in the first position and to a fourth height when in the second position such that the first height is greater than the third height and the fourth height is greater than the second height.

In another embodiment, a game system including a lasso and a first game piece is disclosed. The lasso has an elongated cord portion and a loop portion attached to the elongated cord portion. The loop portion defining a loop diameter. The first game piece includes a base configured to move from a first position to a second position. The game piece includes a fixture and an indicator. The fixture is configured to extend from the base in a first direction and the indicator is configured to extend from the base in a second direction different than the first direction. The first direction extends away from the support surface when in the first position and the second direction extends away from the support surface when in the second position. The fixture also has a width less than the loop diameter such that the loop may engage the fixture.

In yet another embodiment, a method of competing with a lasso and one or more game pieces is disclosed. The method includes arranging the first game piece in a first position, directing a lasso at the first game piece and moving the first game piece from the first position to the second position. The base includes a fixture and an indicator extending therefrom in a first and second direction respectively. The first and second directions are different directions. In the first position, the fixture extends from the base in the first direction away from a supporting surface but in the second position the indicator extends in the second direction away from the supporting surface. The lasso is configured to engage the fixture such that when directed to the game piece the lasso engages the fixture. After engaging the first game piece, the lasso is used to move the first game piece from the first position to the second position.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments of the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

This disclosure is not limited to the specific embodiments and methods described below, as specific components and/or conditions may vary. Furthermore, the terminology used herein is used only for the purpose of describing particular embodiments and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "generally" may be used herein to describe disclosed or claimed embodiments. The term "substantially" may modify a value or relative characteristic disclosed or claimed in the present disclosure. In such instances, "substantially" may signify that the value or relative characteristic it modifies is within ±0%, 0.1%, 0.5%, 1%, 2%, 3%, 4%, 5% or 10% of the value or relative characteristic.

With respect to the terms "comprising," "consisting of," and "consisting essentially of," where one of these three terms is used herein, the presently disclosed and claimed subject matter can include the use of either of the other two terms.

It should also be appreciated that integer ranges explicitly include all intervening integers. For example, the integer range 1-10 explicitly includes 1, 2, 3, 4, 5, 6, 7, 8, 9, and 10. Similarly, the range 1 to 100 includes 1, 2, 3, 4 . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

Figure 1A:
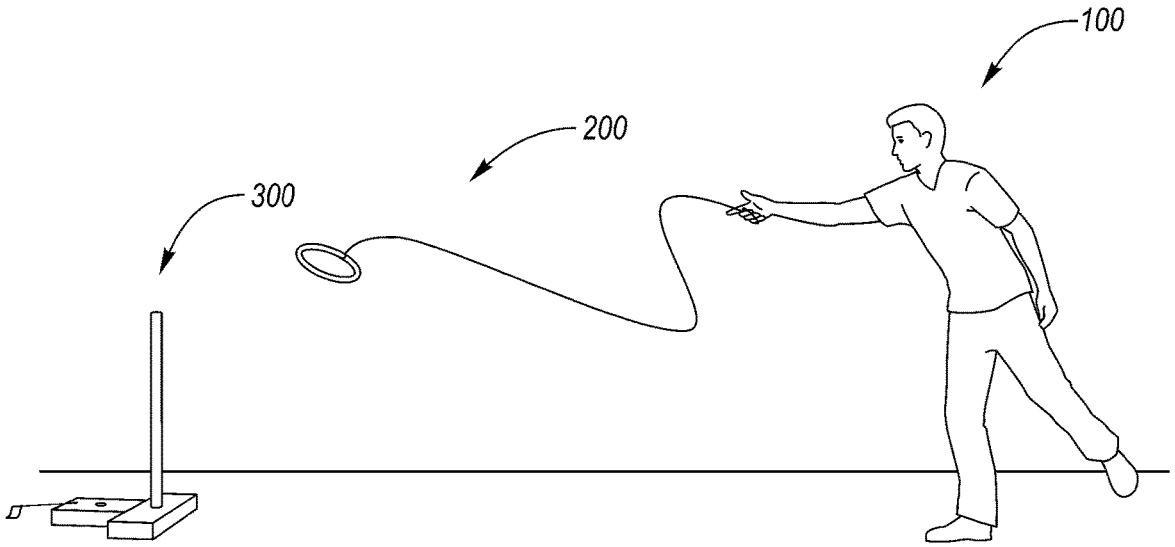
FIG. 1A is a perspective view of a user playing a game.
Figure 1B:
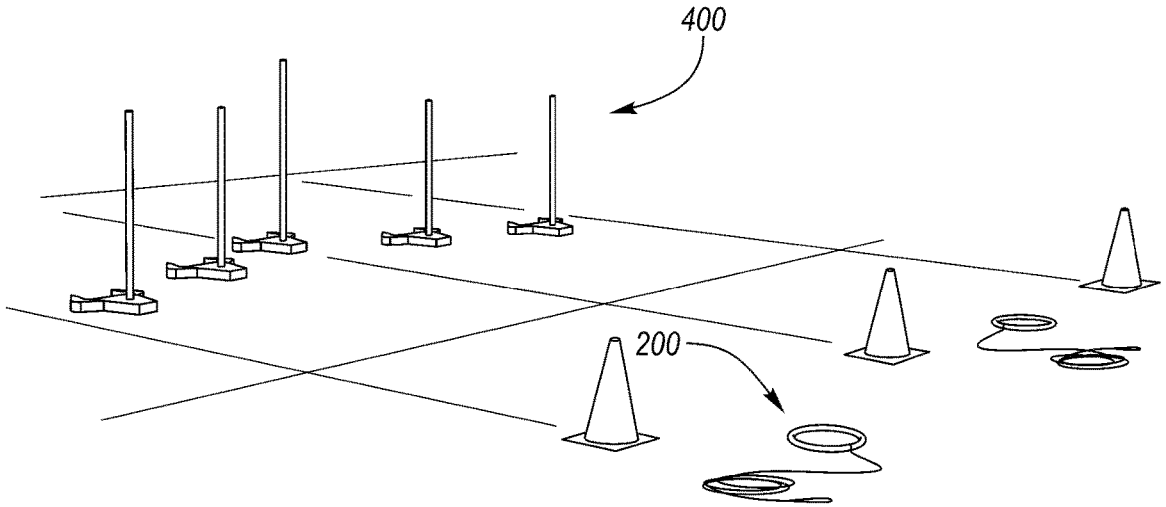
FIG. 1B is a perspective view of a game set up.

A game and a method of playing the same is disclosed. FIG. 1A shows user 100 competing in a game by directing game accessory 200 towards a first game piece 300. The first game piece 300 may be part of a plurality of game pieces 400 as shown in FIG. 1B. User 100 may use the game accessory 200 to change the position of one or more game pieces from a first position (e.g., FIG. 3A/3C) to a second position (e.g., FIG. 3B).

Figure 2:
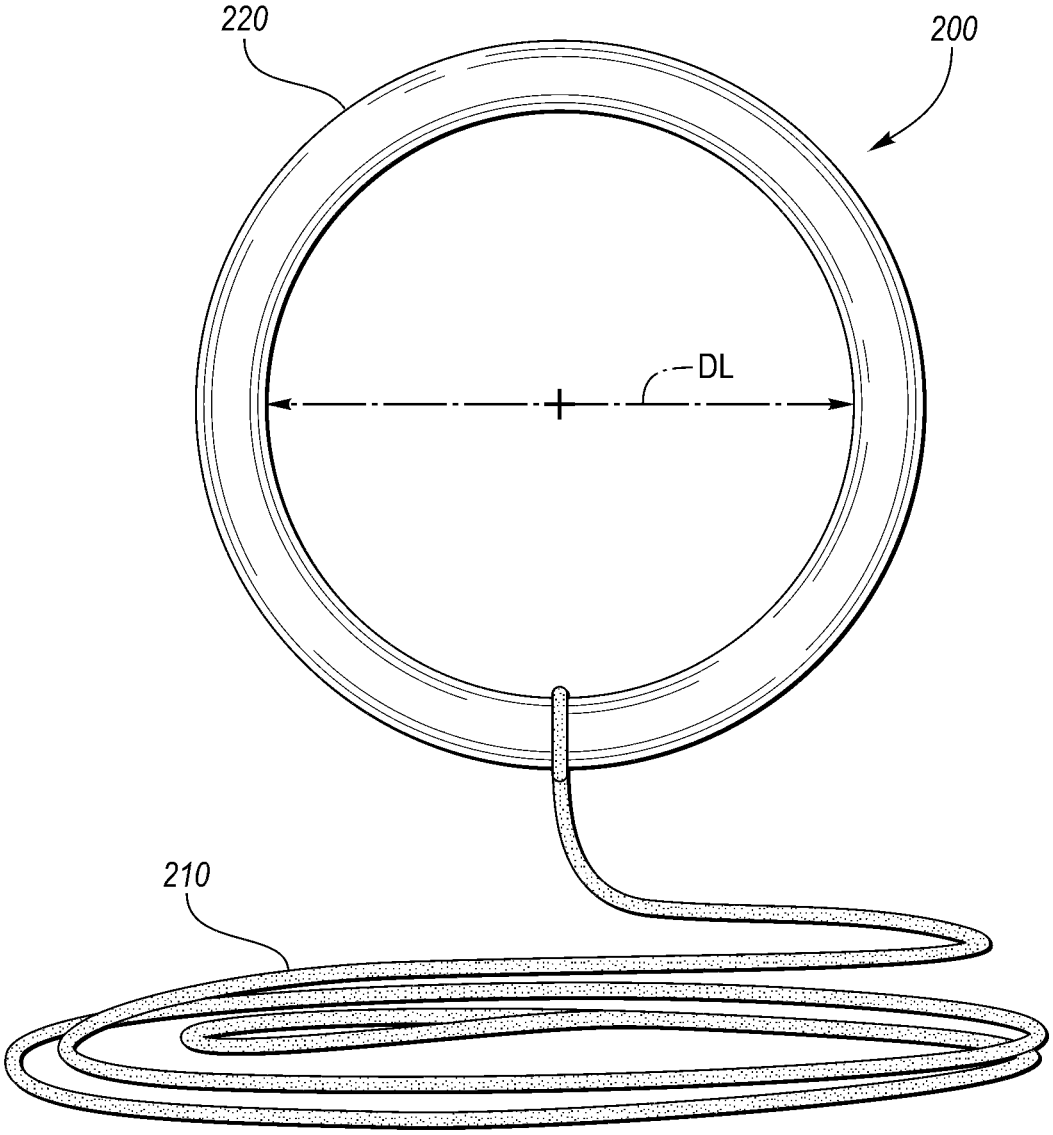
FIG. 2 is a top view of a game accessory (e.g., a lasso).

Game accessory 200, which may be referred to as a lasso, is configured to engage game piece 300 such that it can be used by user 100 to pull or move game piece 300 from the first position to the second position while user 100 is at a distance $D_x$ away from game piece 300. Game accessory 200, as shown in FIG. 2, may have a first portion 210 formed from an elongated flexible cordage-like material and may be referred to broadly as cord including but not limited to rope, cord, twine, cable, wire, chain and/or any combination thereof. Game accessory 200 may also have a second portion 220 attached to the first portion 210. The second portion 220 forms a loop. In one embodiment, second portion 220 may be attached proximal to an end of first portion 210. The second portion 220 may be made of the same or a different material than the first portion 210. The loop may have a fixed shape and size (i.e., doesn't change throughout the competition) or may change its shape and/or size during the competition. The loop may have a diameter $D_L$. For example, the game accessory 200 may have a ring with a 6-inch diameter as the first portion and a 14-foot rope as the second portion.

Figure 3A:
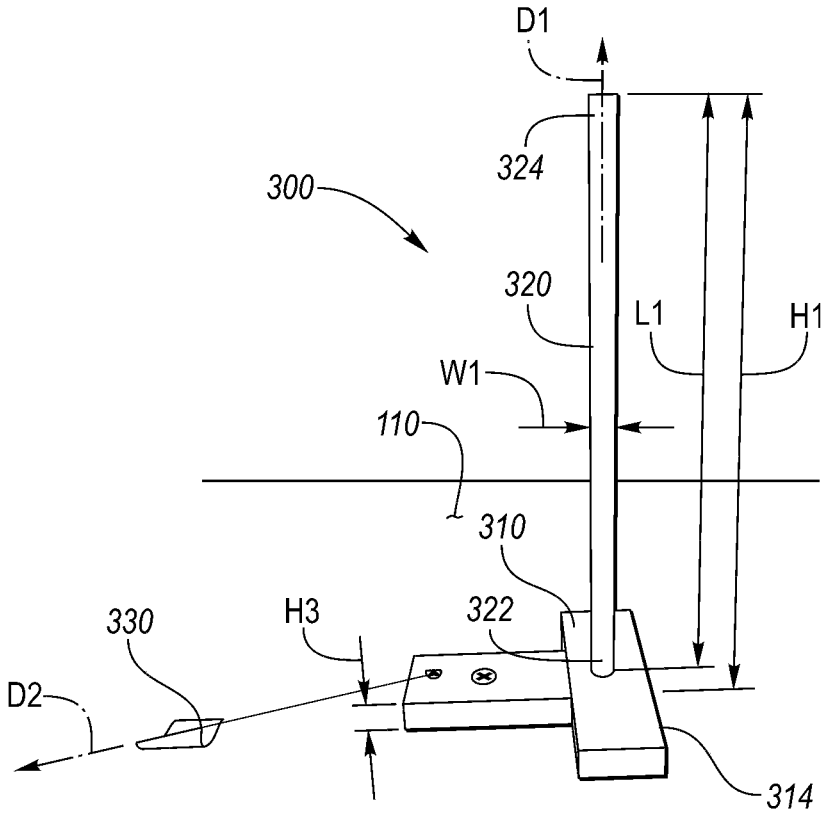
FIGS. 3A and 3B are perspective views of game pieces in a first position.
Figure 3B:
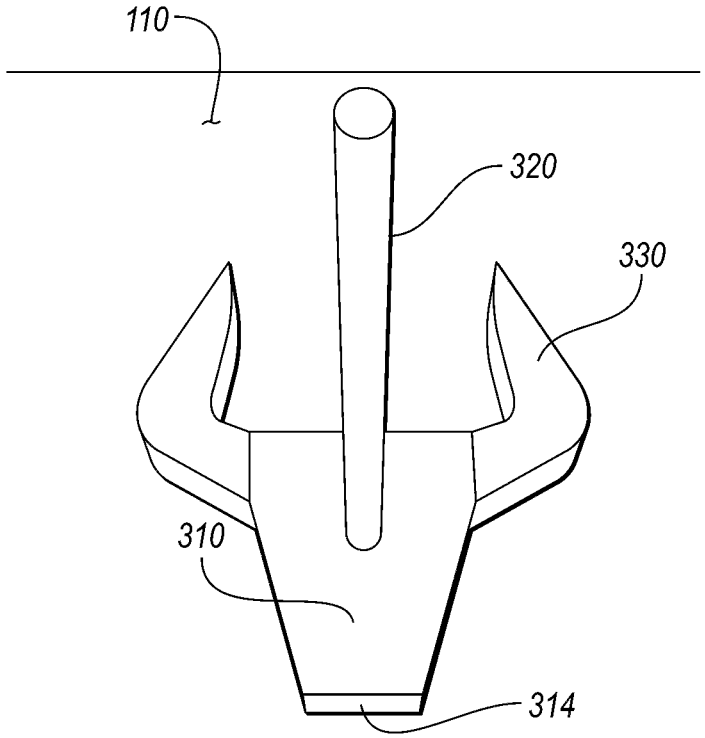
Figure 3C:
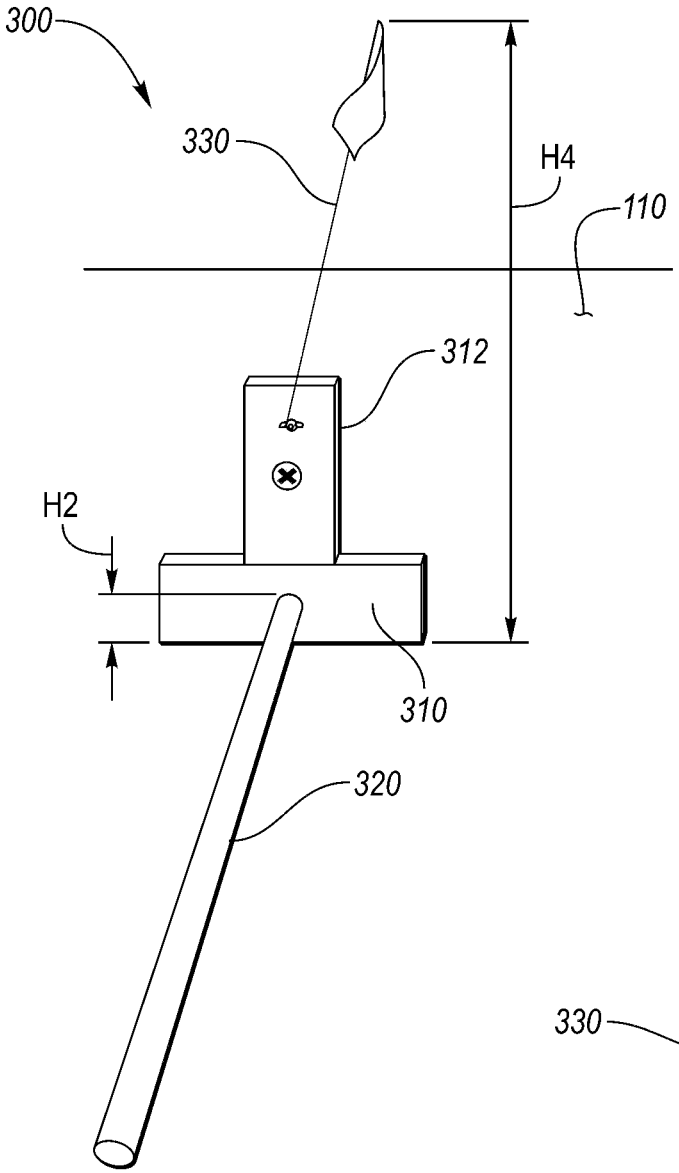
FIGS. 3C and 3D are perspective views of the game pieces in a second position.
Figure 3D:
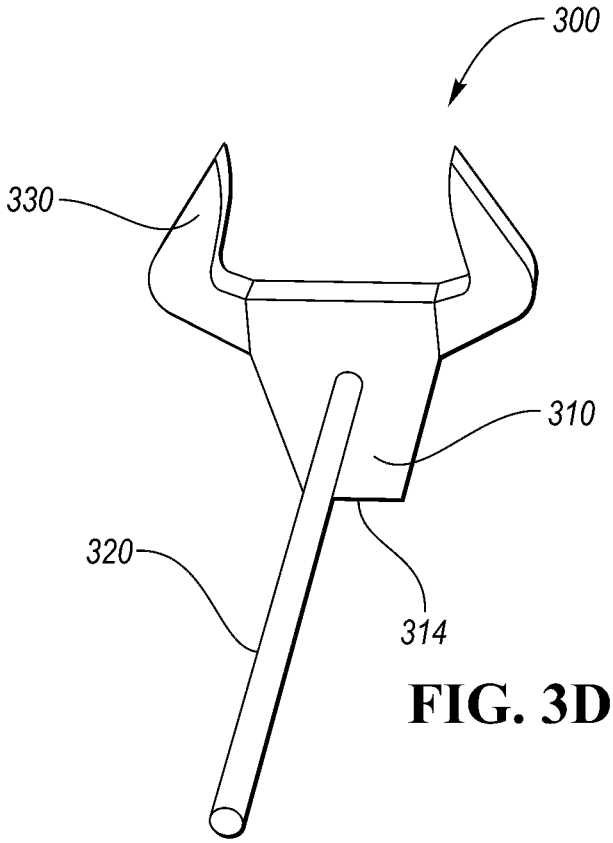
Figure 4A:
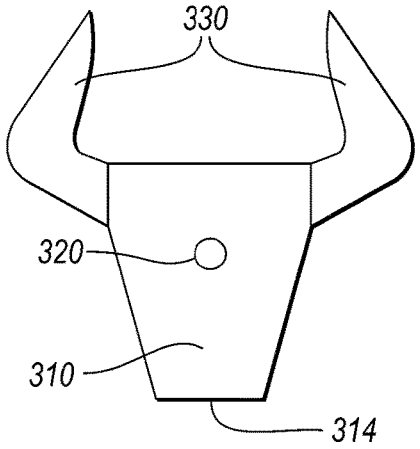
FIG. 4A-F is a top view, bottom view, side views, back view and front view respectively of another embodiment of a game piece.
Figure 4B:
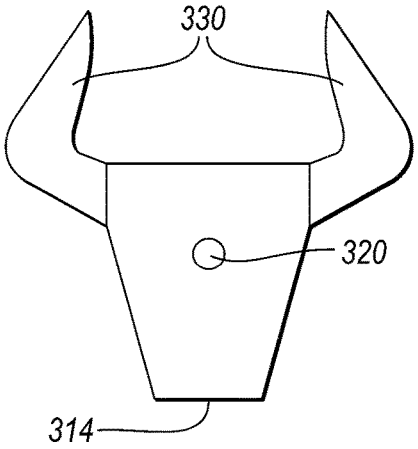
Figure 4C:
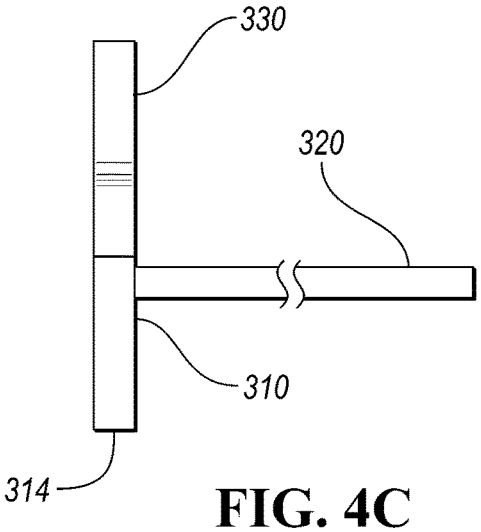
Figure 4D:
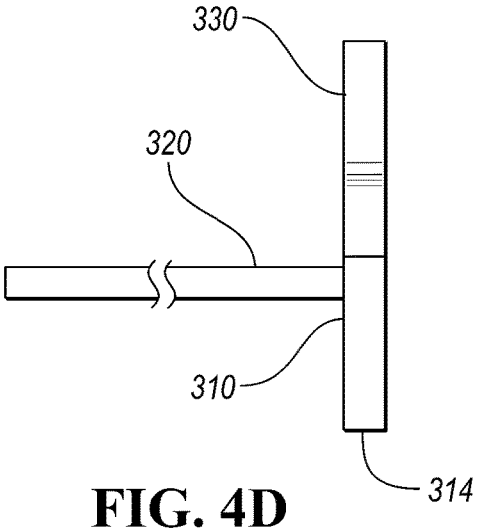
Figure 4E:
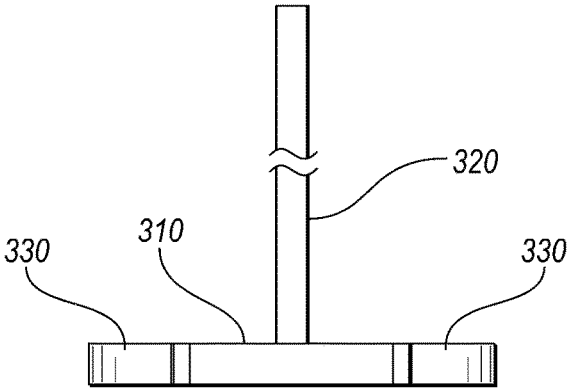
Figure 4F:
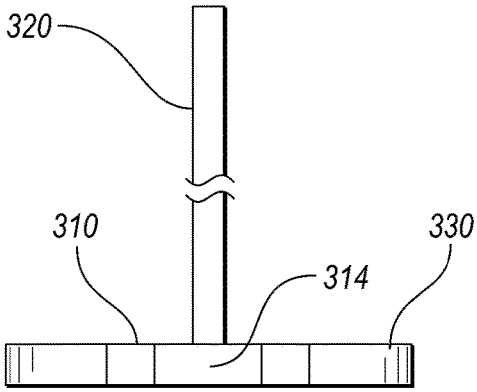
Figure 5:
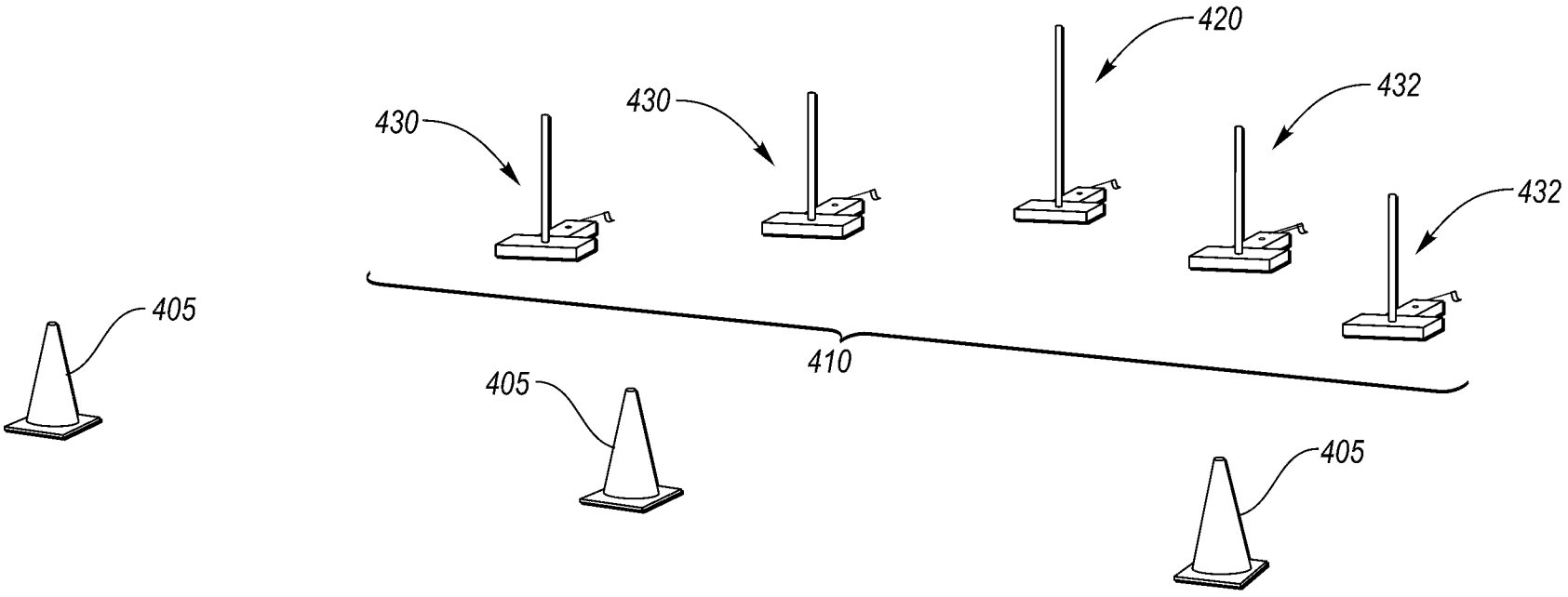
FIG. 5 is a schematic view of a plurality of game pieces arranged for a competition.
Figure 6:
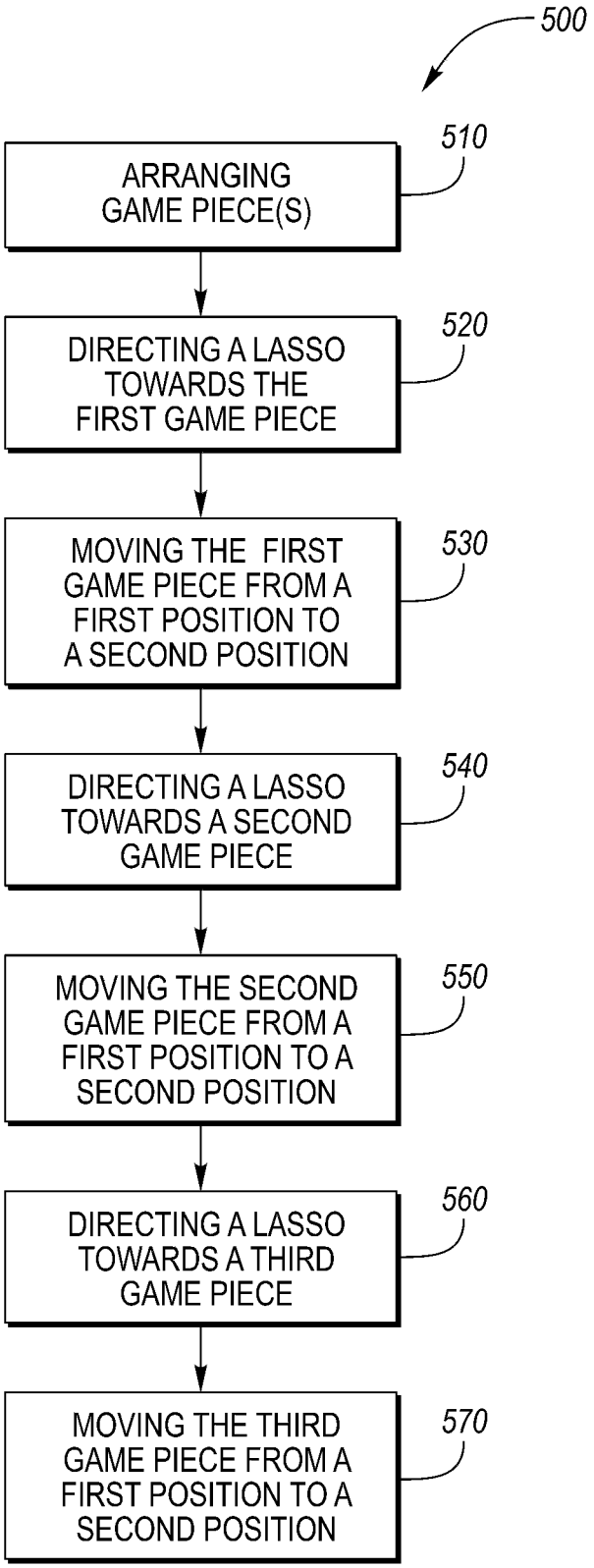
FIG. 6 is a flow chart depicting a method of playing a game.

Game piece 300, as shown in FIGS. 3A-B and 4A-F, includes a base 310, a fixture 320, and an indicator 330. Game piece 300 may be configured to be moved from a first position (e.g., FIG. 3A/3C) to a second position (e.g., FIG. 3B/3D). Base 310 may be supported by support surface 110 in the first and/or second position. Base 310 may be any suitable shape and size for supporting various features that extend therefrom (i.e., fixture 320 and/or indicator 330). For example, the base may be rectangular, triangular, polygonal and/or round. In a variation, base 310 is a cuboid, a cube, a triangular prism, a cylinder, a polygonal prism and/or any combination thereof. In a refinement, the base may be a more complex shape such as, for example, a T-shape, as shown in FIGS. 3A-B or a bull/steer head as shown in FIGS. 4A-F. In a refinement, a block T-shaped base 310 may be 10 inches by 1.5 inches by 2.5 inches with a trunk that is 7 inches by 1.5 inches by 2.5 inches. The 10-inch by 2.5-inch face may also have a hole at its center such as for inserting a ¾-inch fixture 320. Base 310 may have a first section and/or surface 312 (e.g., the 10-inch by 2.5-inch and 7-inch by 2.5-inch faces) that stably rest on and/or is in contact with the support surface 110 when in the first position but also has a second section and/or surface 314 (e.g., 1.5" by 2.5" face) that stably rest on and/or is in contact with the support surface 110 when in the second position.

In yet another refinement, the base 310 may have a bull/steer-head shape. may have a shape configured such that it can easily be moved from resting in the first position to resting in the second position. The bull/steer-head shaped base 310 may have a width of 1.5 inches. The bull head may have a front surface 314 that is 3 inches long and back surface that is 6.75 inches from the front surface and 5.5 inches long. The bull/steer shaped base may include horn shaped indicators 330. A portion of the horn shaped fixtures 330 are adjacent to the head along a 1.75-inch interface. The horns may extend 6.5 inches and 4.75 inches further than the back surface. Side surfaces may extend from the front surface outwardly at an angle to the horn-shaped indicators 330.

The game piece 300 may be configured to be easily moved from a first position to a second position such that the game piece rest easily in the first and second position. For example, a shape with a corner or edge between the first and second section or surface may be used in one or more embodiments. In a refinement, the first section and/or surface 312 may have a first surface area and second section and/or surface 314 may have a second surface area less than the first surface area. In other words, the first surface area may be greater than the second surface area. Base 310 may also be of a sufficient weight (e.g., a weight greater than fixture 320 and/or indicator 330) such that it provides a support for holding up fixture 320 and/or indicator 330. Base 310 may be configured such that the fixture 320 and indicator 330 may be attached to the base 310 prior to a competition.

The fixture 320 extends in first direction $D_1$ from base 310 such that it has a proximal portion and/or end 322 proximate to base 310 and a distal portion and/or end 324 opposite the proximal portion and/or end 322. In the first position, fixture 320 may extend away from support surface 110 but in the second position, fixture 320 may not extend away from the support surface 110, may extend to the support surface 110 or may lie parallel with the support surface 110. Fixture 320 may be elongated and attached to base 310. In a variation, the fixture 320 may have a width Wi less the diameter $D_L$ of the loop of the game accessory 200. In a refinement, the width Wi is less than its length Li. The shape and size of fixture 320 is not particularly limited other than as expressly described herein. Fixture 320, for instance, may be rectangular, circular, round, polygonal or any combination thereof. In a refinement, fixture 320 may be an elongated cylinder. For example, fixture 320 may be a pole, rod, shaft, pin, pillar, and/or column. For example, fixture 320 may be a wooden dowel having a ¾ inch diameter. The dowel may be 2 to 3 feet long. Fixture 320 may extend to a first height $H_1$ from the support surface 110 when game piece 300 is in the first position and a second height $H_2$ from the support surface 110 when game piece 300 is in the second position.

Indicator 330 extends from base 310 and/or the proximal portion and/or end 322 of the fixture 320 in second direction D2 from the base 310 different than first direction $D_1$. In this embodiment, indicator 330 and fixture 320 extend in different directions from base 310. In a refinement, the first direction $D_1$ may be at least 45 degrees different, in other embodiments at least 65 degrees different, or in yet other embodiments at least 90 degrees different. In the second position, indicator 330 may extend away from support surface 110 but in the first position, indicator 330 may not extend away from the support surface 110, may extend to the support surface 110 or may lie parallel with the support surface 110. Indicator 330 acts a visual indication or signal that game piece 300 has been moved to the second position. Indicator 330 may be any suitable shape, size, and material. In a variation, indicator 330 may be visually striking, discernible, and/or distinct such as being bright or a fluorescent color. In a refinement, the indicator 330 may be a flag. For example, indicator 330 may be a flag having a flagpole made of a metal rod or thick wire that is 10 inches long and a fringe that is 2 inches by 4 inches. In a variation, the indicator 330 may be the horns of the bull/steer head.

Indicator 330 may extend from the support surface 110 to a third height $H_3$ when game piece 300 is in the first position and to a fourth height $H_4$ when game piece 300 is in the second position. Third height $H_3$ may be less than first height $H_1$ and fourth height $H_4$ may be greater than second height $H_2$. In other words, fixture 320 may extend further from the support surface 110 than the indicator 330 when in the first position but indicator 330 may extend further from the support surface 110 than the fixture 320 when in the second position. Explained differently, fixture 320 is upright or taller in the first position but indicator 330 is upright or taller in the second position.

A game system is also disclosed. The game system may include a lasso 200 and a first game piece 300. In a variation, the game system includes a plurality of lassos and a plurality of game pieces. The plurality of game pieces may include 2, 3, 4, 5, 6, 7, 8, 9, 10, 11 or more game pieces. In one embodiment, the plurality of game pieces may include at least three game pieces or in other embodiments at least five game pieces. In yet another embodiment, the game system may consist of or consist essentially of a lasso and five game pieces or two lassos and five game pieces. In a refinement, one of the game pieces from the plurality of game pieces (e.g., the first game piece) may be taller (i.e., the fixture extends further from the base) than the remaining or other game pieces. The taller game piece may be referred to as the bull and the shorter game pieces may be referred to as steers. For example, the bull may be 3 feet long and the steers may be 2 feet long. Alternatively, all the game pieces may have the same height or fixture length.

The game system may also include a plurality of boundary cones 405 as shown in FIG. 4. The boundary cones may be used to establish a boundary line from which each user may throw from. For example, three cones may be placed in a line 6.5 feet apart. In a variation, the game system may include 4 steers and 1 bull. The bull may be arranged 9 feet from the center cone. The first and second steer may be arranged 19 inches to each side of the bull and 1 foot closer to the boundary line. The third and fourth steer may be arranged 19 inches to the side furthest from the bull of the first and second steers and again one foot closer to the boundary line than the first and second steers.

The game system may be used for a competition or a method of competing 500. The competition may include arranging a game piece or a plurality of game pieces to form a shape. Each game piece may be positioned in a first position such that the fixture extends from the base in a first direction away from the supporting surface (i.e., 510). The shape may be any suitable shape. In a refinement, the shape may be symmetrical. For example, the shape may be a pointed shape, a line, a box shape, a round shape, a W-shape, or a V-shape as shown in FIG. 4. A first user directs the lasso (configured to engage the fixture) towards the game piece(s) (i.e., step 520) until engaging the fixture with the lasso. After engaging the fixture, the user moves the game piece from the first position to the second position by pulling or moving the lasso in a third direction different than the first direction (i.e., step 530). In the second position, the indicator may stick up or extend away from the supporting surface such that it is more visible or discernible. Simultaneously, a second user may direct a second lasso towards the game piece(s) to engage and move it to the second position.

In a refinement, the plurality of game pieces 410 includes at least three game pieces or in other embodiments at least five game pieces. The plurality of game pieces 410 may include a taller game piece (i.e., the bull 420). The bull 420 may be arranged in the center. First and second users may compete by each directing a lasso towards a different steer or group of steers (i.e., target steers) 430, 432. Upon engaging and moving each of the targeted steers 430 or 432 from the first position to the second position the user may direct the lasso towards the bull 420 to engage it and move it from the first position to the second position. The first or second user may be declared the winner upon moving all their target steers 430 or 432 from the first position to the second position and the bull 420 from the first position to the target position. When directing the lasso towards one or more game pieces the user may hold the first portion of the lasso and toss the second portion of the lasso towards the game pieces 410 such that if it engages a game piece the second portion can be moved or pulled in the third direction to move the game piece from the first position to the second position. In a variation, steps 510 through 530 may be directed to a steer and repeated for additional steers and/or a bull. For example, the method or competing may include arranging a bull and/or a plurality of steers at step 510. Directing the lasso towards a target steer (i.e., step 520) and engaging the steer such that the steer can be moved from a first position to a second position (i.e., step 530), this may be repeated by directing the lasso to a second target steer (i.e., step 540) and engaging the steer such that the steer can be moved from a first position to a second position (i.e., step 550). This can again be repeated but by directing the lasso towards the bull (i.e., step 560) and engaging the bull/third steer such that the bull/third steer can be moved from a first position to a second position (i.e., step 570).

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A method of competing comprising:

arranging a first game piece in a first position, the first game piece having a fixture extending from a base in a first direction and an indicator extending from the base in a second direction, the first direction extending away from a supporting surface when in the first position;

directing a lasso, configured to engage the fixture, towards the first game piece; and moving the first game piece from the first position to a second position, using the lasso, such that the indicator extends away from the supporting surface when in the second position.

2. The method of claim 1, further comprising engaging the fixture using the lasso prior to moving the first game piece from the first position to the second position.

3. The method of claim 2, wherein moving the first game piece from the first position to the second position includes moving the lasso in a third direction different than the first direction.

4. The method of claim 3, wherein directing the lasso towards the first game piece includes throwing a second portion of the lasso while holding a first portion of the lasso and moving the lasso in the third direction includes pulling the second portion.

5. The method of claim 4, wherein the second portion is a loop, and the first portion is a rope.

6. The method of claim 1, further comprising arranging a plurality of game pieces including the first game piece and moving a portion of the plurality of game pieces from the first position to the second position using the lasso.

7. The method of claim 1, wherein the second direction is at least 45 degrees from the first direction.

8. The method of claim 1, wherein the indicator is a flag.

* * * * *